US006536638B1

(12) United States Patent
Gulmatico, III

(10) Patent No.: US 6,536,638 B1
(45) Date of Patent: Mar. 25, 2003

(54) CONVERTIBLE EQUIPMENT BAG AND BACK PACK

(76) Inventor: Ramon Gulmatico, III, 1007 Verona Dr., Fullerton, CA (US) 92835

( * ) Notice: Subject to any disclaimer, the term of this patent is extended or adjusted under 35 U.S.C. 154(b) by 0 days.

(21) Appl. No.: 09/943,012

(22) Filed: Aug. 29, 2001

(51) Int. Cl.[7] ..... A45F 4/02
(52) U.S. Cl. ..... 224/153; 224/581; 224/586
(58) Field of Search ..... 224/153, 580, 224/581, 582, 586

(56) References Cited

U.S. PATENT DOCUMENTS

| | | | | |
|---|---|---|---|---|
| 4,515,300 A | | 5/1985 | Cohen | |
| 4,518,107 A | | 5/1985 | Amos | |
| 4,553,779 A | | 11/1985 | Shortridge | |
| 4,655,343 A | * | 4/1987 | Lane et al. | 206/287.1 |
| 4,793,535 A | | 12/1988 | Johnson | |
| 4,951,816 A | * | 8/1990 | Smith | 206/279 |
| 4,958,760 A | | 9/1990 | Mule et al. | |
| 5,399,020 A | | 3/1995 | Cheng | |
| 5,425,449 A | * | 6/1995 | Boorady | 206/287.1 |
| 5,454,643 A | * | 10/1995 | Sullivan | 383/4 |
| 5,490,619 A | * | 2/1996 | Boyar | 224/153 |
| D386,300 S | | 11/1997 | Kopel | |
| 6,092,702 A | * | 7/2000 | Cassidy, IV | 224/153 |

FOREIGN PATENT DOCUMENTS

| | | |
|---|---|---|
| WO | WO 96/32860 | 10/1996 |

* cited by examiner

*Primary Examiner*—Stephen K. Cronin
(74) *Attorney, Agent, or Firm*—Gene Scott-Patent Law & Venture Group

(57) ABSTRACT

A convertible bag has a front panel peripherally engaging a rear panel. The front panel defines an harness pouch encompassing an upper portion of the front panel. A flap 60 may be positioned over the harness pouch closing it with a zipper 70. The flap 60 alternately is positionable to one side of the front panel 30 to expose a carry harness 80. The lower portion of the elongated bag 13 is adapted for folded placement exteriorly to the rear panel in positional opposition to the harness pouch. In this position the flap covers the folded lower portion 13 and the zipper 70 joins the flap 60 over the rear panel 30 thereby forming a back pack for carrying the elongated bag and other items as desired.

2 Claims, 4 Drawing Sheets

CONVERTIBLE EQUIPMENT BAG AND BACK PACK

BACKGROUND OF THE INVENTION

1. Field of the Invention

This invention relates generally to equipment bags and back packs and more particularly to a convertible equipment bag for carrying equipment, especially sports equipment, that can also be worn as a back pack while using the sports equipment.

2. Description of Related Art

The following art defines the present state of this field:

Kopel, U.S. Des. Pat. No. 386,300 describes a clutch sized bag expandable to backpack design.

Cohen, U.S. Pat. No. 4,515,300 describes a multiple-use sports bag may be easily convertible to one of four separate bags: a bike bag, a shoulder bag, a belt bag, and, in particular, a backpack. The multiple-use sports bag comprises a pouch-like body having a first open storage space and a space adjacent thereto, a backpack folded up inside the adjacent space, Velcro strips for securing the backpack inside the body, a first zipper for providing access to the backpack, and pull tabs on opposite sides of the zipper for opening and closing the pouch. In a second embodiment, a second zipper is arranged parallel to the first zipper and extends almost completely around three contiguous walls of the pouch-like body. This second zipper provides access to a second open storage space on another side of the pouch-like body and allows the pouch-like body to open and close a suitcase-like manner.

Amos, U.S. Pat. No. 4,518,107 describes a light weight carrier system primarily for use in carrying skis and/or poles on the user's back between the shoulders. The carrier system 2 includes a plaint back body portion 4 including a top holding strap 6 and a bottom holding strap 8, each with a closure means. A pair of shoulder harness straps 14 and 16 are each attached to opposite side edges of body portion 4. In use, carrier 2 is placed horizontally and open on a substantially flat surface with straps 6 and 8 on top and accessible. A pair of skis 32, having toe binding 34 and heel binding 36, and and/or a pair of ski poles 38, are then placed on reinforcing strip 26 of body portion 4 between straps 6 and 8 with, for example, toe portion 34 of the binding above strap 6 and heel portion 36 of the binding above strap 8. Straps 6 and 8 are then secured tightly around the skis and/or poles and the entire carrier system lifted and placed on the user's back and between the shoulders, preferably at an oblique vertical, angle by means of harness straps 14 and 16. In preferred embodiments the ski carrier system is convertible to a waist belt when it is not being used as a carrier. In one preferred embodiment a belted pack 42 is combined with carrier 2 into which pack the carrier may be placed when not being used as a carrier.

Shortridge, U.S. Pat. No. 4,553,779 describes a foldable clutch or caddy for carrying elongated objects such as skis, ski poles and the like which can be readily folded and tucked away in a pocket when not in use comprises a main body of pliable fabric or other material which wraps around a first set of objects such as skis, and an auxiliary flap of material for wrapping around a second set of objects such as ski poles. One or more looped ribbons stitched to the main body form carrying handles. Various patches of hook and loop fastener material attached at strategic locations on the main body and flap combine to provide various forms of closure in both carrying and folded mode of the clutch.

Johnson, U.S. Pat. No. 4,793,535 describes a sack for carrying and transporting a surfboard which sack may be used in its first form as a back-pack carrier for the surfboard, and in its second form as a roof-rack for transporting the surfboard by a vehicle. Four strap portions are provided having either a male coupler or female coupler at its free end. Each free end also has associated with it a hook for attaching the sack to the rain gutters of the roof of a vehicle. Length adjusters are provided for adjusting the length of the band to one end of which is attached the hook for the rain gutter. A pouch is also provided on each strap portion for storing the hook and its band during non-use. A zipper-closure is provided at the tail end portion of the sack to allow for storage of two surfboards in the sack. A separate compartment is provided for storing personal belongings. The outer portion of the sack has a portion provided with a mesh in order to ventilate the interior of the sack.

Mule et al., U.S. Pat. No. 4,958,760 describes a multi-purpose carrier for skis and the like comprising a combination ski-boot and ski-protection bag that can be converted to a back-pack. This convenient unit, designated as a "Mule Pack" is adapted to be strapped to the roof rack of a car using the same straps that support the back-pack.

Cheng, U.S. Pat. No. 5,399,020 describes a bag for carrying objects wherein the bag is constructed to be collapsed into a pouch for easy carrying. The bag is constructed from a flexible shell member having a bottom. A base support member is attached to the bottom of the bag for providing support to the bottom when the bag is in use. The bag is flexible so that it can be folded down to the base support member and the base support member folded and fastened with a zipper. In the folded and fastened configuration, the base support is constructed as a pouch. Another zipper is provided in the base support for closing an opening provided in the base support. When the bag is collapsed into the pouch, the second zipper cooperates with the bottom of the bag to define a pocket for storage of objects.

Boyar, U.S. Pat. No. 5,49,619 describes a device for providing a plurality of ways for transporting articles wherein a bag, which is relatively large and flexible, is contained in a purse, which is relatively small, so that the purse may be turned inside out to expose the bag and wherein the bag has an internal volume many times greater than the volume of the purse and wherein the bag has a top portion which may be opened so that articles can be placed in the bag and closed to retain the articles therein and wherein the purse is located inside of the bag when in use and wherein the bag is provided with webbing so that the bag may be carried as a backpack, a shoulder bag or a hand bag.

Smith et al, WO 96/32860 describes a stowage system particularly for space applications comprising a flight bag, a backpack, a backpack adapter plate, and a pressurized stowage rack. The flight bag is fabricated of a Kevlar™/Nomex™ fabric, and its lid includes an integral transparent panel so that the contents of the bag may be readily identifiable without opening the bag. Beneath the lid is a payload restraint net which is removably attache dot the interior liner of the bag to restrain small stowage items. The mesh comprising the net preferably include one or more access slits for accessing the interior of the case without removing the net and thereby risking loss of contents fro the bag. The flight bag also includes a plurality of hook and loop (VELCRO™) patches about its periphery so that it may be collapsed upon itself for storage when not in use. And may additionally be rafted or trained to other flight bags if desired. The backpack of the inventive stowage system comprising various configurations and can accommodate up to four flight bags or some combination of unique payload and/or foam. Web straps, integral to the bag's structure, attach the bag and its contents to the backpack adapter plate via quick release buckles. A clear longitudinal panel on the lid allows quick identification of backpack and flight bag contents.

The prior art teaches the use of convertible bags such as Mule' et al which teaches an elongated bag that is adapted for being converted to a pack but does not teach how to enclosure the bag within itself, and Cohen which teaches a sports bag convertible to a back pack, but fails to teach a double acting flap that is reversible for sealing a backpack harness and alternately for enclosing the bulk of the sports bag when it is converted to a pack. The present invention fulfills these needs and provides further related advantages as described in the following summary.

SUMMARY OF THE INVENTION

The present invention teaches certain benefits in construction and use which give rise to the objectives described below.

Sports bags are available for carrying snow boards, skis and other lengthy sports equipment. These bags provide convenience when carrying plural items and in preventing damage to this equipment. A problem arises, however, when one reaches the sports field, such as a mountain top or other remote location at a ski center, for instance. Where can the sports bag be stored? The present invention provides a solution. A convertible bag has a front panel peripherally engaging a rear panel. The front panel provides an harness pouch encompassing an upper portion of the front panel. A flap is positioned over the harness pouch closing it with a zipper. The flap alternately is positionable to one side of the front panel to expose a carry harness within the harness pouch. The lower portion of the elongated bag, when empty, is adapted for folded placement exteriorly to the rear panel in positional opposition to the harness pouch. In this position the flap covers the folded lower portion and the zipper joins the flap over the rear panel thereby forming a back pack for carrying the elongated bag. When the sports equipment is ready to go back into the bag, the steps are reversed enabling the harness and the sports equipment to be stowed for transport.

A primary objective of the present invention is to provide an apparatus and method of use of such apparatus that provides advantages not taught by the prior art.

Another objective is to provide such an invention capable of being used as a sports bag for snow boards and similar long objects.

A further objective is to provide such an invention capable of converting the sports bag into a back pack after the long objects have been removed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
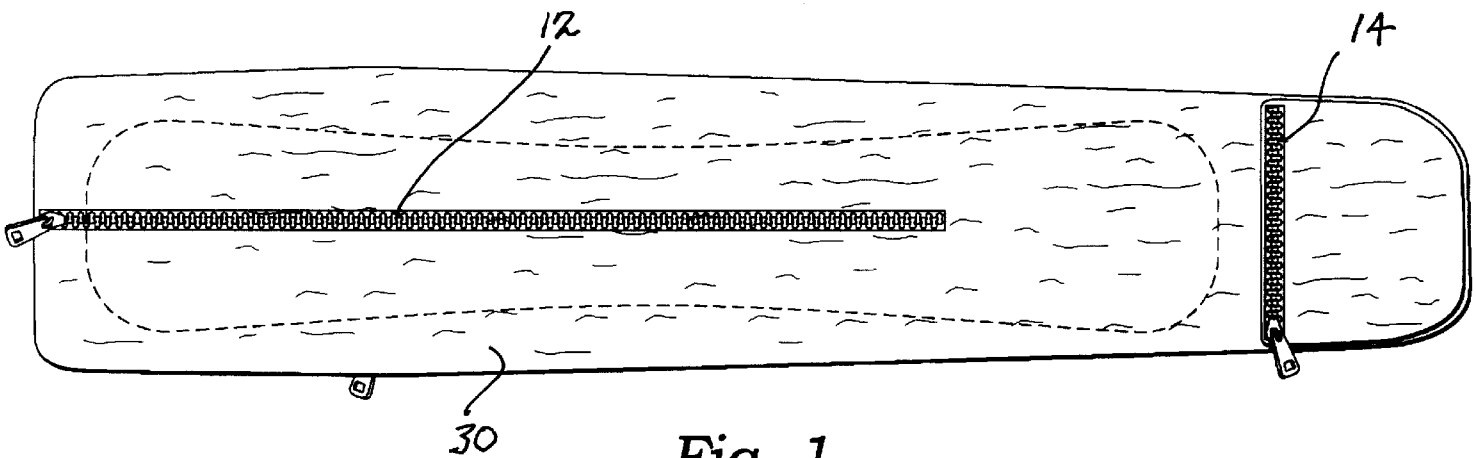
FIG. 1 is a rear plan view of the preferred embodiment of the invention.
Figure 2:
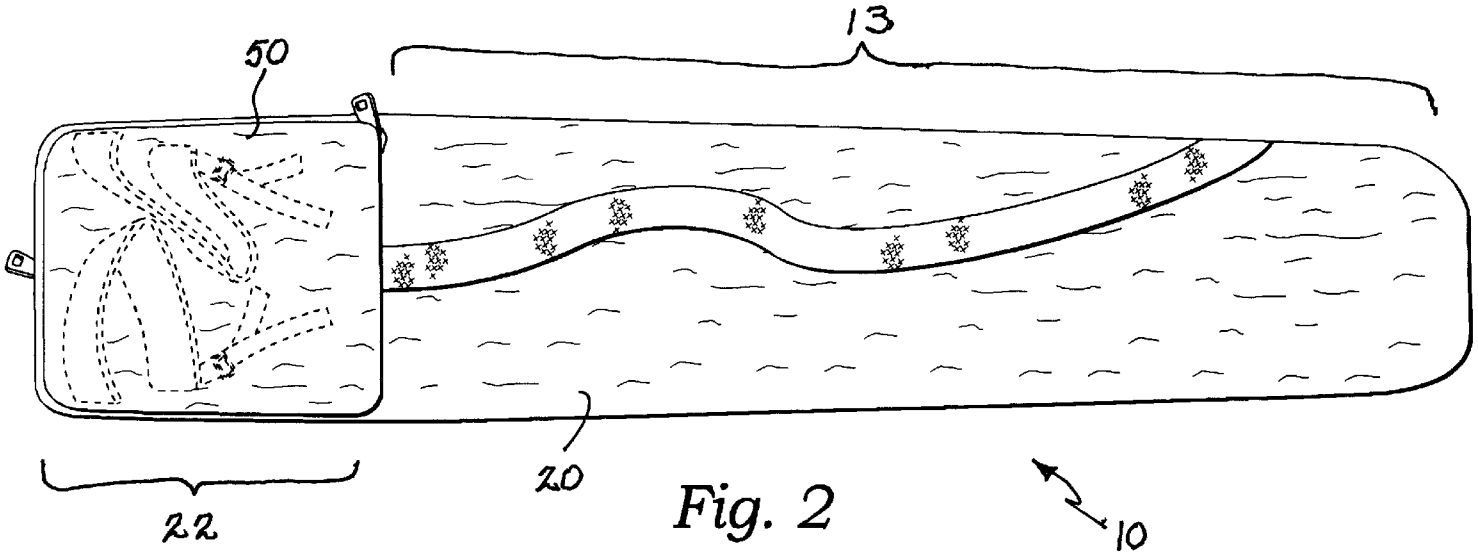
FIG. 2 is a front plan view thereof.
Figure 3:
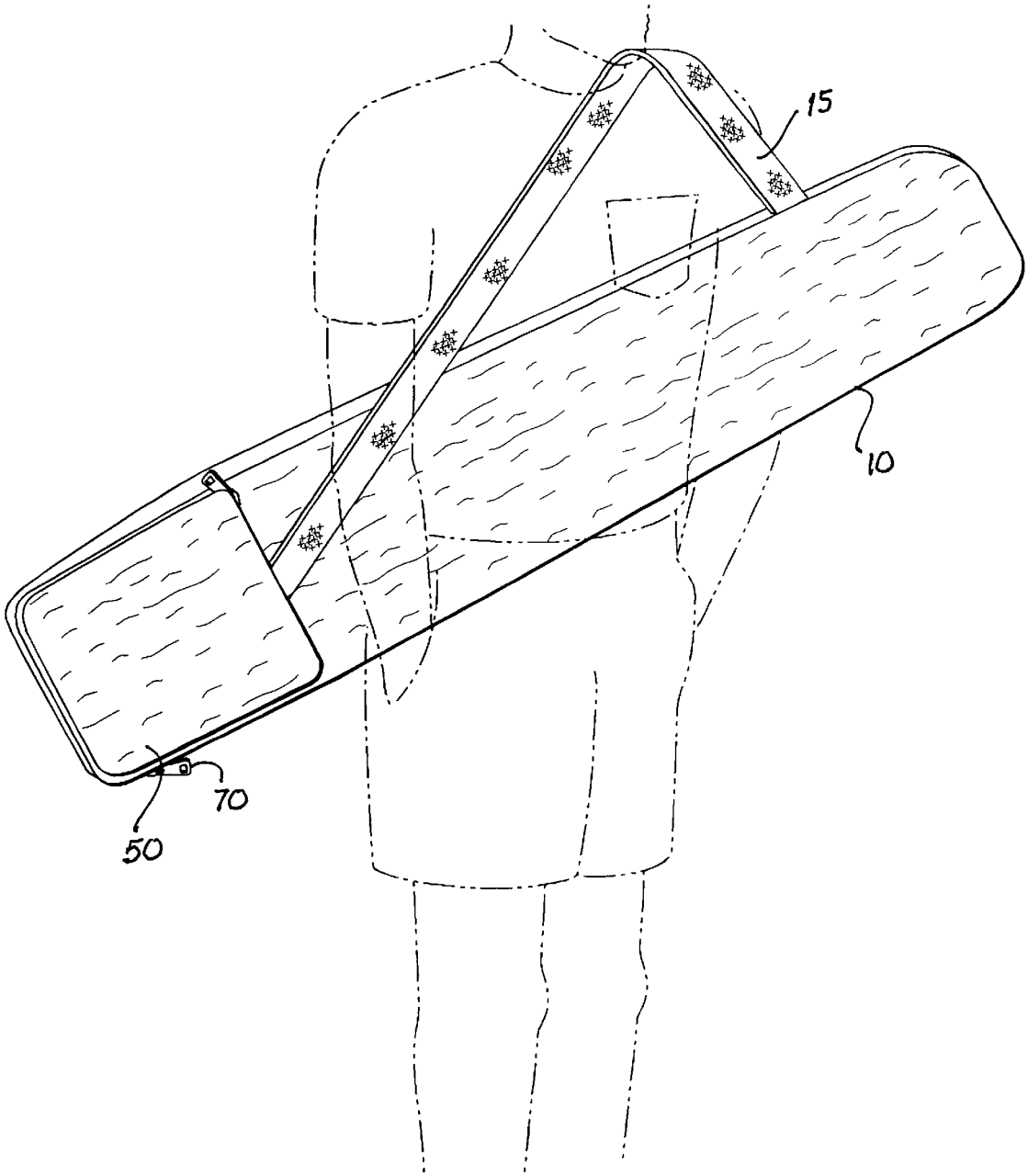
FIG. 3 is a perspective view thereof showing a manner of carrying the invention and enclosed sporting equipment.
Figure 4:
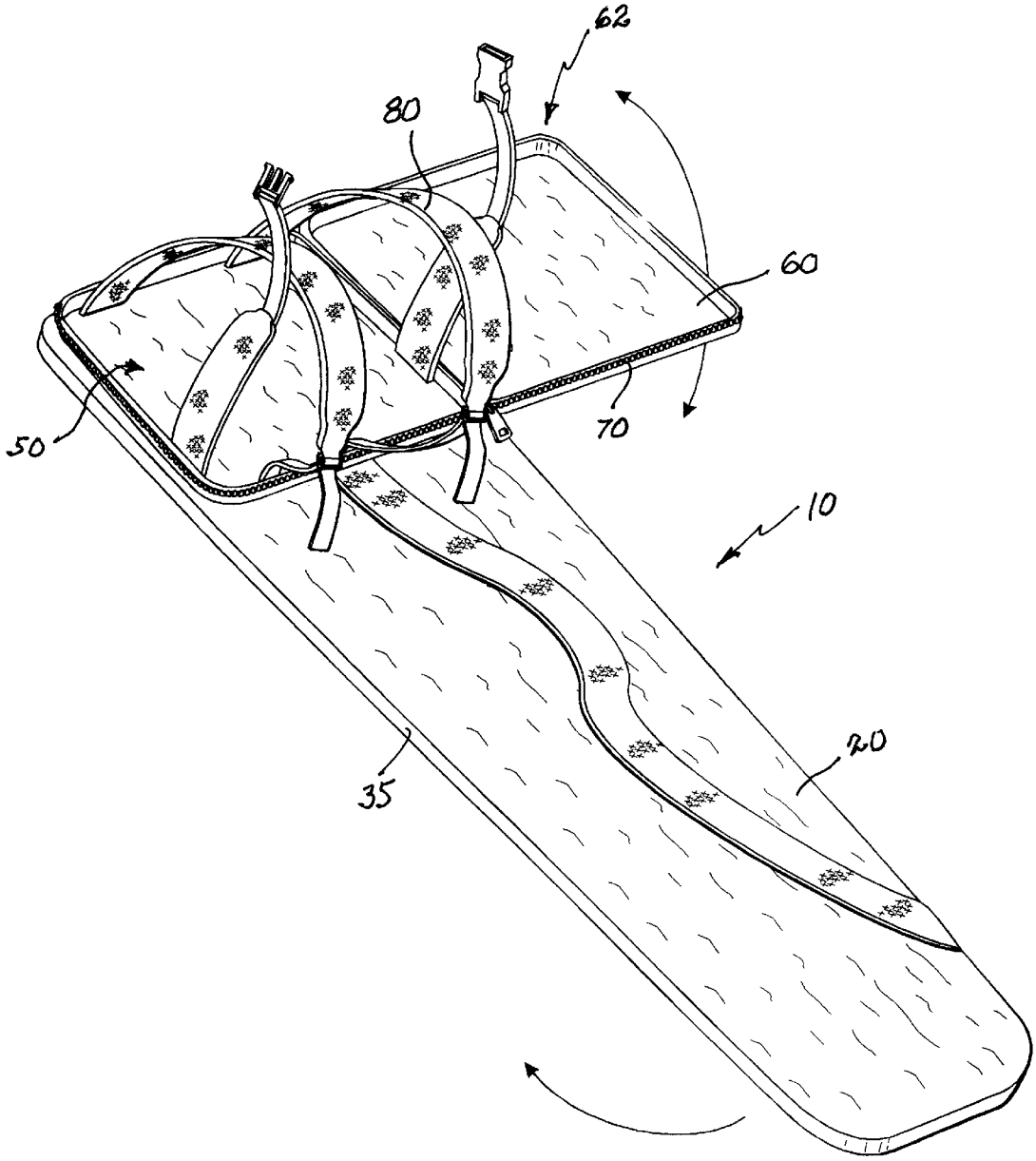
FIG. 4 is perspective view thereof with a flap shown drawn to one side of an access aperture.
Figure 6:
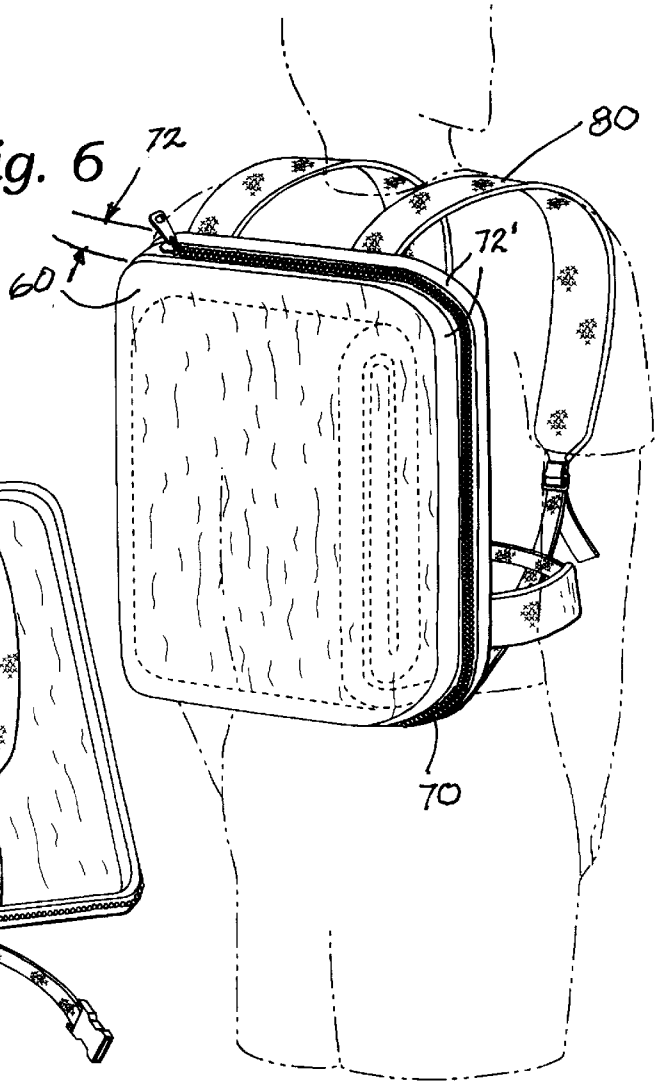
FIG. 6 is a perspective view thereof showing a final step in reversing the flap over the folded lower portion and closing the flap with a zipper closure so as to form a back pack.
Figure 5:
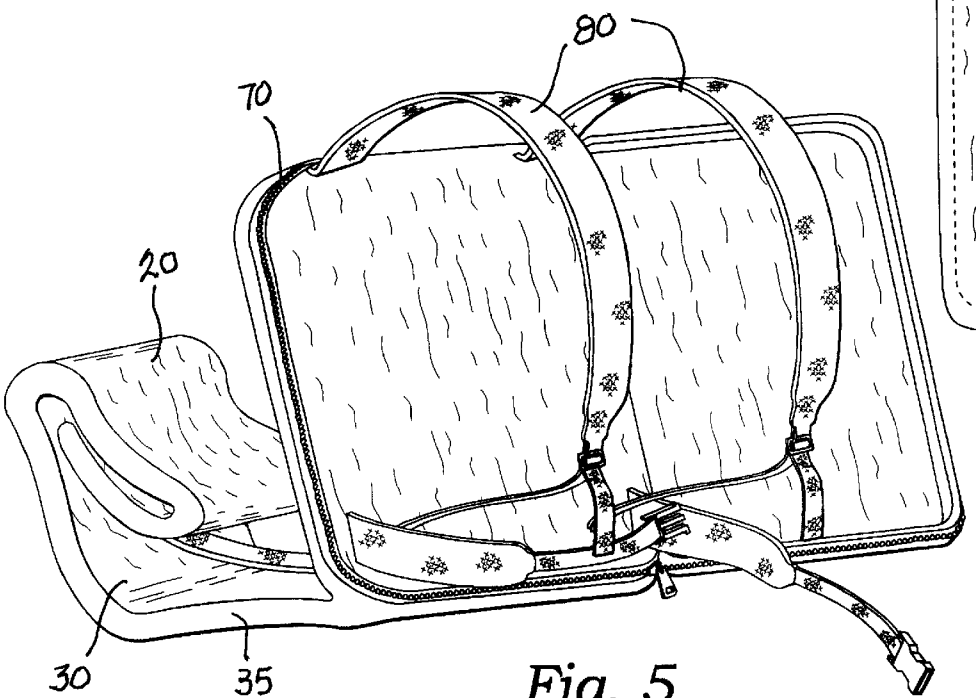
FIG. 5 is a perspective view thereof similar to FIG. 4 but showing a first step in folding the invention by placement of a lower portion thereof to the rear of the access aperture.

A convertible bag apparatus, preferably made of a touch fabric, comprises an elongated bag 10 providing a front panel 20 peripherally engaging a rear panel 30, thereby defining an enclosed storage space between the panels. Preferably, a shoulder strap 15 is mounted on the apparatus for carrying the elongated bag 10 when it encloses equipment, such as a snow board or the like. FIG. 1 shows the rear view of the elongated bag 10 with zippers 12 and 14 for gaining access to the interior. Side panels 35 may be employed for producing a bag with greater volume. The front panel 20 provides a harness pouch 50 mounted thereon and this pouch 50 encompasses an upper portion 22 of the front panel 20. This defines a lower portion 12 of the elongated bag 10. A flap 60 is adapted for being positioned over the harness pouch 50 and a closure device 70, such as a zipper, is adapted for joining the flap 60 to the front panel 20 for closing the harness pouch 50. The flap 60 is alternately positionable to one side 62 of the front panel 20 as shown in FIG. 4 for fully exposing that portion of the front panel 20 encompassed by the pouch 50. A carry harness 80 is engaged with the front panel 20 in a position where the harness 80 may be alternately enclosed within the harness pouch 50, as shown in FIG. 2, or extended out of the harness pouch 50, as shown in FIGS. 4 and 5 for use in carrying the lower portion 13 and other miscellaneous items that might be normally carried in a field pack or as a back pack. See FIG. 6. The lower portion 13 of the elongated bag 10 is adapted by its dimension and bulk, for folded placement exteriorly to the upper portion of the rear panel in positional opposition to the access aperture of the front panel. This is shown in FIG. 5. The flap 60 is adapted by its placement, for being positionally reversed for covering the folded lower portion of the elongated bag 10 as shown in FIG. 6. The closure device 70 is further adapted for joining the flap 60 over the rear panel 30 thereby forming a back pack structure for carrying the lower portion 13 of the elongated bag as shown in FIG. 6. The means by which the flap 60 is able to encompass the carry harness 80, as well as the bulk of the lower portion 13 of the apparatus when it is folded is by providing an appropriate width 72 (see FIG. 6) of the closure device 70. This width 72, in the preferred embodiment comprises a zipper 70 which has a width selectable fabric portion 72'. By selecting the fabric portion to provide adequate depth, the carry harness 80 and the lower portion of the bag 10 both may be easily enclosed by the flap 60. A method of converting the bag apparatus comprising the steps of peripherally engaging the front panel 20 to the rear panel 30, to define the enclosed storage space between the panels for forming the elongated bag 10, mounting the harness pouch 50 in the upper portion 22 of the front panel 20; attaching the flap 60 over the harness pouch 50 preferably by sewing; providing the closure device 70 adapted for joining the flap 60 to the harness pouch 50 for closing the harness pouch 50; positioning the flap 60 to the one side 62 of the front panel 20; mounting the carry harness 80 on the front panel 20 within the harness pouch 50; extending the carry harness 80 out of the harness pouch 50; folding the lower portion 12 of the elongated bag 10 into the position exterior to the rear panel in positional opposition to the harness pouch 50 on the front panel 20; covering the folded lower portion 12 of the elongated bag 10 with the flap 60; and joining the flap 60 over the rear panel 30 with the closure device 70 thereby forming a back pack for carrying the elongated bag.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A convertible bag apparatus comprising: an elongated bag providing a front panel peripherally engaging a rear panel, thereby defining an enclosed storage space between the panels; the front panel defining an harness pouch therein encompassing an upper portion of the front panel, and thereby defining a lower portion of the elongated bag; a flap adapted for being positioned over the harness pouch and a closure device adapted for joining the flap to the front panel for closing the harness pouch; the flap alternately positionable to one side of the front panel; a carry harness engaged with the front panel and adapted for alternate enclosure within the harness pouch, and extending out of the harness pouch; said lower portion of the elongated bag adapted for folded placement exteriorly to the rear panel in positional opposition to the harness pouch of the front panel; the flap adapted for covering the folded lower portion of the elongated bag, the closure device further adapted for joining the flap over the rear panel thereby forming a back pack for carrying the elongated bag.

2. A method of converting a bag apparatus comprising the steps of: peripherally engaging a front panel to a rear panel, to define an enclosed storage space between the panels for forming an elongated bag; forming an harness pouch in an upper portion of the front panel; attaching a flap over the harness pouch; providing a closure device adapted for joining the flap to the front panel for closing the harness pouch; positioning the flap to one side of the front panel; mounting a carry harness on the front panel in a position for being enclosed within the harness pouch; extending the carry harness out of the harness pouch; folding a lower portion of the elongated bag into placement exteriorly to the rear panel in positional opposition to the harness pouch of the front panel; covering the folded lower portion of the elongated bag with the flap; and joining the flap over the rear panel with the closure device thereby forming a back pack for carrying the elongated bag.

* * * * *